US009458801B2

(12) United States Patent
Dudar et al.

(10) Patent No.: US 9,458,801 B2
(45) Date of Patent: Oct. 4, 2016

(54) FUEL SYSTEM LEAK CHECK BASED ON FUEL REID VAPOR PRESSURE

(71) Applicant: Ford Global Technologies, LLC, Dearborn, MI (US)

(72) Inventors: Aed M. Dudar, Canton, MI (US); Dennis Seung-Man Yang, Canton, MI (US); Rob Ognjanovski, Jr., Shelby Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 434 days.

(21) Appl. No.: 14/069,176

(22) Filed: Oct. 31, 2013

(65) Prior Publication Data

US 2015/0114089 A1 Apr. 30, 2015

(51) Int. Cl.
*F02M 25/08* (2006.01)
*F02D 41/00* (2006.01)

(52) U.S. Cl.
CPC ..... *F02M 25/0809* (2013.01); *F02D 41/0045* (2013.01); *F02D 2200/0611* (2013.01)

(58) Field of Classification Search
CPC ..... F02M 25/0809; F02D 2200/0611; F02D 41/2267
See application file for complete search history.

(56) References Cited

U.S. PATENT DOCUMENTS 5,637,788 A 6/1997 Remboski et al.
6,196,203 B1 3/2001 Grieve et al.
6,227,177 B1 * 5/2001 Yamafuji ..... F02D 41/0042 123/399
6,237,575 B1 * 5/2001 Lampert ..... F02D 41/0042 123/516
6,321,727 B1 11/2001 Reddy et al.
7,165,446 B2 * 1/2007 Miyahara ..... F02M 25/08 73/114.39
7,448,367 B1 11/2008 Reddy et al.
7,942,134 B2 5/2011 Peters et al.
8,056,397 B2 11/2011 Herzog et al.
8,181,631 B2 * 5/2012 Bohr ..... F02M 25/0854 123/520
2009/0120065 A1 * 5/2009 Uhrich ..... F02D 41/0025 60/284
2012/0016566 A1 * 1/2012 Cunningham ..... F02D 37/02 701/103
2013/0269660 A1 * 10/2013 Peters ..... F02M 25/08 123/520

OTHER PUBLICATIONS

Anonymous, "Method to reduce fuel volatility in PHEV vehicles to improve Evap monitor robustness and emissions," IPCOM No. 000238130D Published Aug. 4, 2014, 2 pages.
Majkowski, S. et al., "Development and Validation of a 0.020" Evaporative Leak Diagnostic System Utilizing Vacuum Decay Methods," SAE Technical Paper Series 1999-01-0861, International Congress and Exposition, Detroit, MI., Mar. 1-4, 1999, 9 pages.
Deronne, M. et al., "The Development and Implementation of an Engine Off Natural Vacuum Test for Diagnosing Small Leaks in Evaporative Emissions Systems," SAE Technical Paper Series 2003-01-0719, 2003 SAE World Congress, Detroit, MI., Mar. 3-6, 2003, 13 pages.
Kobayashi, M. et al., "Evaporative Leak Check System by Depressurization Method," SAE Technical Paper Series 2004-01-0143, 2004 SAE World Congress, Detroit MI., Mar. 8-11, 2004, 9 pages.
Cavina, N. et al., "Development of Model-Based OBDII-Compliant Evaporative Emissions Leak Detection Systems," SAE Technical Paper Series 2008-01-1012, 2008 SAE International Congress, Detroit, MI., Apr. 14-17, 2008, 11 pages.

* cited by examiner

*Primary Examiner* — Francis Gray
(74) *Attorney, Agent, or Firm* — James Dottavio; Alleman Hall McCoy Russell & Tuttle LLP

(57) ABSTRACT

A method for an evaporative emissions leak test, comprising: adjusting a pressure threshold based on a fuel volatility of a fuel contained in a fuel tank; and performing the evaporative emissions leak test based on the adjusted pressure threshold. By determining fuel volatility and adjusting a pressure threshold based on the fuel volatility, a more robust and accurate evaporative emissions leak test may be employed without adding additional components to a fuel system.

20 Claims, 6 Drawing Sheets

FUEL SYSTEM LEAK CHECK BASED ON FUEL REID VAPOR PRESSURE

BACKGROUND AND SUMMARY

Vehicle emission control systems may be configured to store fuel vapors from fuel tank refueling and diurnal engine operations, and then purge the stored vapors during a subsequent engine operation. In an effort to meet stringent federal emissions regulations, emission control systems may need to be intermittently diagnosed for the presence of leaks that could release fuel vapors to the atmosphere.

Evaporative leaks may be identified using engine-off natural vacuum (EONV) during conditions when a vehicle engine is not operating. In particular, a fuel system may be isolated at an engine-off event. The pressure in such a fuel system will increase if the tank is heated further as liquid fuel vaporizes. As a fuel tank cools down, a vacuum is generated therein as fuel vapors condense to liquid fuel. Vacuum generation is monitored and leaks identified based on expected vacuum development or expected rates of vacuum development. In some vehicles, such as in plug-in hybrid electric vehicles, engine run time is limited and a vacuum pump is required to perform leak detection. The vacuum pump may be included in an evaporative leak check module (ELCM) which draws vacuum across a reference orifice to obtain a reference vacuum to which evacuated fuel tank vacuum is compared.

However, both EONV and ELCM based leak tests are prone to error when a fuel with a high Reid Vapor Pressure (RVP) is present in the fuel system. For an EONV test, highly volatile fuel may produce a pressure which counteracts leaks in the fuel system, causing a false pass during the pressure-rise portion of the EONV test. For an ELCM test, the fuel vapor of a high RVP fuel may counteract the vacuum pull of the ELCM pump, causing a false failure during the ELCM test.

The inventors herein have recognized the above problems, and have developed systems and methods to at least partially address the problems. In one example, a method for an evaporative emissions leak test, comprising: adjusting a pressure threshold based on a fuel volatility of a fuel contained in a fuel tank; and performing the evaporative emissions leak test based on the adjusted pressure threshold. In this way, both positive pressure tests and negative pressure tests may compensate for fuel volatility in setting pressure thresholds. For example, vehicles using highly volatile fuel (e.g. winter fuel) during warmer ambient temperatures may set incorrect pressure thresholds based on ambient temperature, barometric pressure, etc. that may cause false pass results for positive pressure tests and may cause false fail results for negative pressure tests. By determining fuel volatility and adjusting a pressure threshold based on the fuel volatility, a more robust and accurate evaporative emissions leak test may be employed without adding additional components to a fuel system.

In another example, a method for an evaporative emissions system leak test, comprising: determining a reference vacuum threshold; venting fuel vapor from a fuel tank; determining a fuel Reid Vapor Pressure of the fuel vapor; adjusting the reference vacuum threshold based on the fuel Reid Vapor Pressure; drawing a vacuum on a fuel tank with an evaporative leak check module; and indicating degradation of the evaporative emissions system based on the adjusted reference vacuum threshold. In this way, false failures may be reduced for an evaporative leak check module based test. In a fuel system using a fuel with a high Reid Vapor Pressure, the fuel vapor may counteract the vacuum pull of an evaporative leak check module. As such, the resulting test vacuum may not reach the expected reference vacuum threshold, indicating a leak in the fuel system even if the system is intact. By compensating for the fuel Reid Vapor Pressure, an accurate reference vacuum threshold may be determined, resulting in a more accurate test with fewer false failures.

In yet another example, a method for an evaporative emissions system leak test, comprising: responsive to an engine off condition, closing a canister vent valve; determining a resulting pressure of a fuel tank; determining a Reid Vapor Pressure of a fuel in the fuel tank; determining a threshold pressure based on the fuel Reid Vapor Pressure; and comparing the resulting pressure of the fuel tank to the threshold pressure. In this way, false passes may be reduced for an engine-off natural vacuum test. In a fuel system using a fuel with a high Reid Vapor Pressure, the fuel vapor may result in an increased fuel tank pressure during the pressure rise portion of the test. This may indicate an intact fuel system, when in fact the fuel system is degraded. By compensating for the fuel Reid Vapor Pressure, an accurate pressure threshold may be determined, resulting in a more accurate test with fewer false passes.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

DETAILED DESCRIPTION

Figure 1:
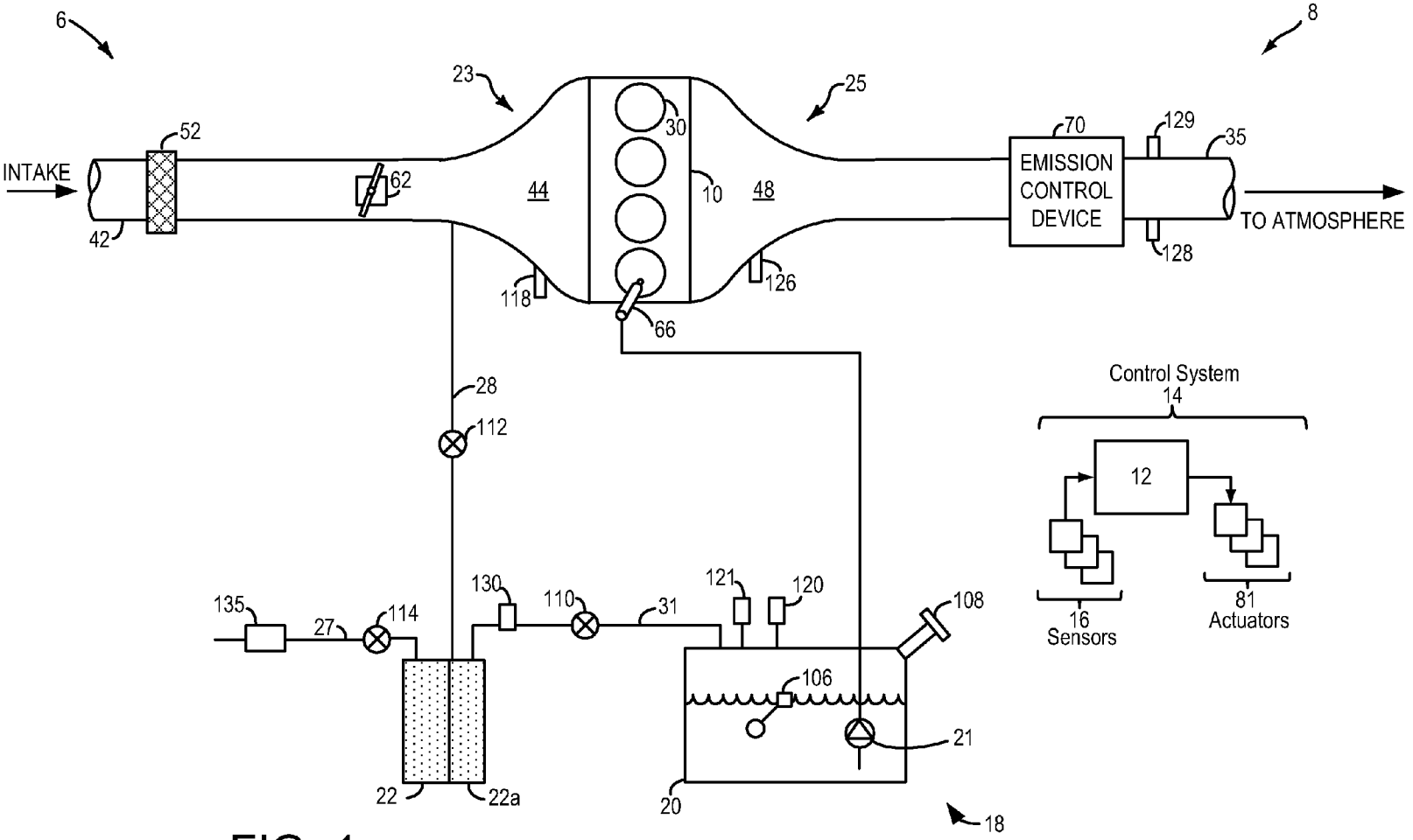
FIG. 1 shows a schematic depiction of a fuel system coupled to an engine system.

This description relates to systems and methods for leak testing of a fuel system coupled to an engine, such as the fuel system and engine system depicted in FIG. 1. The fuel system and engine system may be included in a hybrid vehicle, and may necessitate the inclusion of an evaporative leak check module (ELCM). An ELCM may be configured to adapt conformations, such as the conformations shown in FIGS. 2A-2C. A controller or power train control module (PCM) may be configured to perform a control routine for an ELCM test, such as the method depicted in FIG. 3. The method may include determining the Reid Vapor Pressure (RVP) of a fuel included in the fuel tank, and further may include adjusting an ELCM test threshold based on the determined RVP. Example ELCM tests are shown in FIGS. 4A-4B. The controller may also be configured to test for leaks using a method for an engine-off natural vacuum test, such as the method depicted in FIG. 5. The method may include determining the Reid Vapor Pressure (RVP) of a fuel included in the fuel tank, and further may include adjusting an EONV test threshold based on the determined RVP. Example EONV tests are shown in FIGS. 6A-6B. In this way, fuel system leak tests may be performed across a wide range of fuel RVPs with a reduced risk of false-pass and/or false-fail indications.

FIG. 1 shows a schematic depiction of a hybrid vehicle system 6 that can derive propulsion power from engine system 8 and/or an on-board energy storage device, such as a battery system (not shown). An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 8 is coupled to a fuel system 18. Fuel system 18 includes a fuel tank 20 coupled to a fuel pump 21 and a fuel vapor canister 22. During a fuel tank refueling event, fuel may be pumped into the vehicle from an external source through refueling port 108. Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor canister 22, via conduit 31, before being purged to the engine intake 23.

Fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23 by opening canister purge valve 112. While a single canister 22 is shown, it will be appreciated that fuel system 18 may include any number of canisters. In one example, canister purge valve 112 may be a solenoid valve wherein opening or closing of the valve is performed via actuation of a canister purge solenoid.

Canister 22 may include a buffer 22*a* (or buffer region), each of the canister and the buffer comprising the adsorbent. As shown, the volume of buffer 22*a* may be smaller than (e.g., a fraction of) the volume of canister 22. The adsorbent in the buffer 22*a* may be same as, or different from, the adsorbent in the canister (e.g., both may include charcoal). Buffer 22*a* may be positioned within canister 22 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine.

Canister 22 includes a vent 27 for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28 and purge valve 112. While this example shows vent 27 communicating with fresh, unheated air, various modifications may also be used. Vent 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. In one example, canister vent valve 114 may be a solenoid valve wherein opening or closing of the valve is performed via actuation of a canister vent solenoid. In particular, the canister vent valve may be an open that is closed upon actuation of the canister vent solenoid. In some examples, an air filter may be coupled in vent 27 between canister vent valve 114 and atmosphere.

As such, hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system.

To address this, a fuel tank isolation valve 110 may be optionally included in conduit 31 such that fuel tank 20 is coupled to canister 22 via the valve. During regular engine operation, isolation valve 110 may be kept closed to limit the amount of diurnal or "running loss" vapors directed to canister 22 from fuel tank 20. During refueling operations, and selected purging conditions, isolation valve 110 may be temporarily opened, e.g., for a duration, to direct fuel vapors from the fuel tank 20 to canister 22. By opening the valve during purging conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits. While the depicted example shows isolation valve 110 positioned along conduit 31, in alternate embodiments, the isolation valve may be mounted on fuel tank 20.

One or more pressure sensors 120 may be coupled to fuel system 18 for providing an estimate of a fuel system pressure. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 directly coupled to fuel tank 20, in alternate embodiments, the pressure sensor may be coupled between the fuel tank and canister 22, specifically between the fuel tank and isolation valve 110. In still other embodiments, a first pressure sensor may be positioned upstream of the isolation valve (between the isolation valve and the canister) while a second pressure sensor is positioned downstream of the isolation valve (between the isolation valve and the fuel tank), to provide an estimate of a pressure difference across the valve. In some examples, a vehicle control system may infer and indicate a fuel system leak based on changes in a fuel tank pressure during a leak diagnostic routine.

One or more temperature sensors 121 may also be coupled to fuel system 18 for providing an estimate of a fuel system temperature. In one example, the fuel system temperature is a fuel tank temperature, wherein temperature sensor 121 is a fuel tank temperature sensor coupled to fuel tank 20 for estimating a fuel tank temperature. While the depicted example shows temperature sensor 121 directly coupled to fuel tank 20, in alternate embodiments, the temperature sensor may be coupled between the fuel tank and canister 22.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) or manifold vacuum (ManVac) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode (e.g., during a fuel tank refueling operation and with the engine not running), wherein the controller 12 may open isolation valve 110 and canister vent valve 114 while closing canister purge valve (CPV) 112 to direct refueling vapors into canister 22 while preventing fuel vapors from being directed into the intake manifold.

As another example, the fuel system may be operated in a refueling mode (e.g., when fuel tank refueling is requested by a vehicle operator), wherein the controller 12 may open isolation valve 110 and canister vent valve 114, while maintaining canister purge valve 112 closed, to depressurize the fuel tank before allowing enabling fuel to be added therein. As such, isolation valve 110 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 12 may open canister purge valve 112 and canister vent valve while closing isolation valve 110. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. Hydrocarbon sensor 130 is shown coupled to conduit 31 between isolation valve 110 and canister 22. In other embodiments, hydrocarbon sensor 130 may be coupled directly to or within canister 22. Additionally or alternatively, one or more oxygen sensors (not shown) may be coupled to the canister 22 (e.g., downstream of the canister), or positioned in the engine intake and/or engine exhaust. One or both of hydrocarbon sensor 130 and the one or more oxygen sensors may be configured to provide an estimate of a canister load (that is, an amount of fuel vapors stored in the canister). Based on the canister load, and further based on engine operating conditions, such as engine speed-load conditions, a purge flow rate may be determined.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, MAP sensor 118, pressure sensor 120, and pressure sensor 129. Other sensors such as additional pressure, temperature, air/fuel ratio, and composition sensors may be coupled to various locations in the vehicle system 6. As another example, the actuators may include fuel injector 66, isolation valve 110, purge valve 112, vent valve 114, fuel pump 21, and throttle 62.

Control system 14 may further receive information regarding the location of the vehicle from an on-board global positioning system (GPS). Information received from the GPS may include vehicle speed, vehicle altitude, vehicle position, etc. This information may be used to infer engine operating parameters, such as local barometric pressure. Control system 14 may further be configured to receive information via the internet or other communication networks. Information received from the GPS may be cross-referenced to information available via the internet to determine local weather conditions, local vehicle regulations, etc. Control system 14 may use the internet to obtain updated software modules which may be stored in non-transitory memory.

The control system 14 may include a controller 12. Controller 12 may be configured as a conventional microcomputer including a microprocessor unit, input/output ports, read-only memory, random access memory, keep alive memory, a controller area network (CAN) bus, etc. Controller 12 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines. Example control routines are described herein with regard to FIGS. 3 and 5.

Leak detection routines may be intermittently performed by controller 12 on fuel system 18 to confirm that the fuel system is not degraded. As such, leak detection routines may be performed while the engine is off (engine-off leak test) using engine-off natural vacuum (EONV) generated due to a change in temperature and pressure at the fuel tank following engine shutdown and/or with vacuum supplemented from a vacuum pump. Alternatively, leak detection routines may be performed while the engine is running by operating a vacuum pump and/or using engine intake manifold vacuum. Leak tests may be performed by an evaporative leak check module (ELCM) 135 communicatively coupled to controller 12. ELCM 135 may be coupled in vent 27, between canister 22 and the atmosphere. ELCM 135 may include a vacuum pump for applying negative pressure to the fuel system when administering a leak test. ELCM 135 may further include a reference orifice and a pressure sensor. One embodiment of ELCM 135 is discussed in detail further herein and with regards to FIGS. 2A-2C. Following the applying of vacuum to the fuel system, a change in pressure at the reference orifice (e.g., an absolute change or a rate of change) may be monitored and compared to a threshold. Based on the comparison, a fuel system leak may be diagnosed.

Figure 2A:
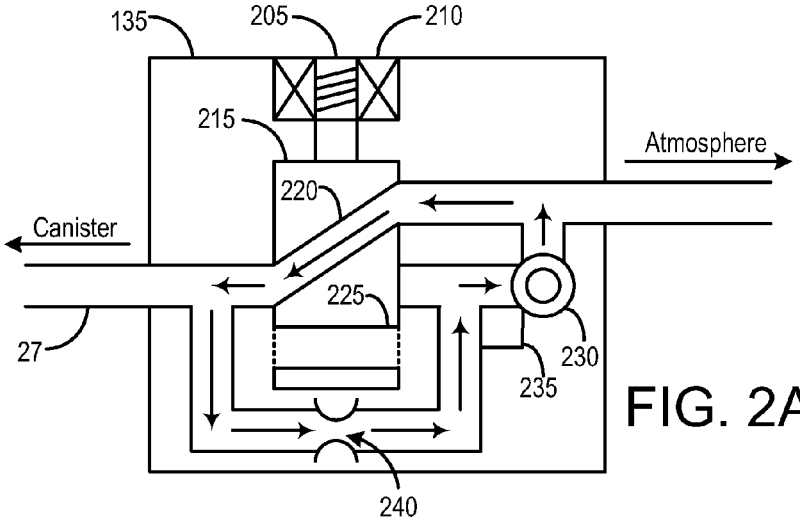
FIG. 2A shows a schematic depiction of an evaporative leak check module in a configuration to perform a reference check.
Figure 2B:
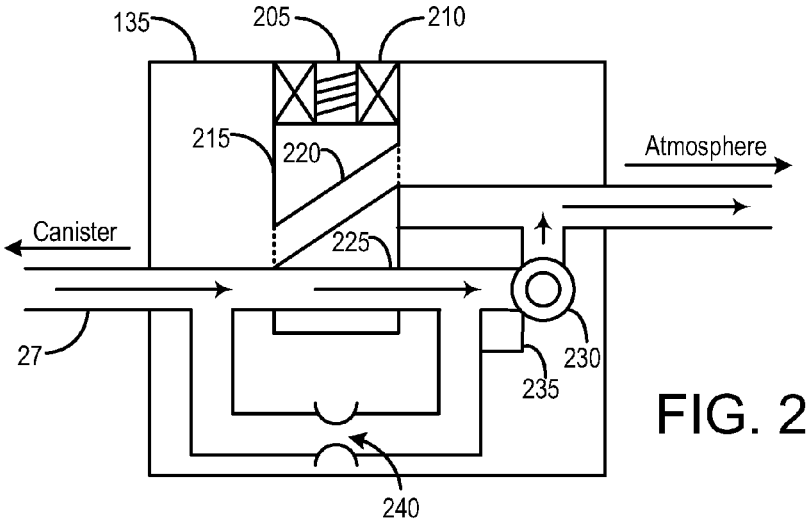
FIG. 2B shows a schematic depiction of an evaporative leak check module in a configuration to perform a tank evacuation leak check.
Figure 2C:
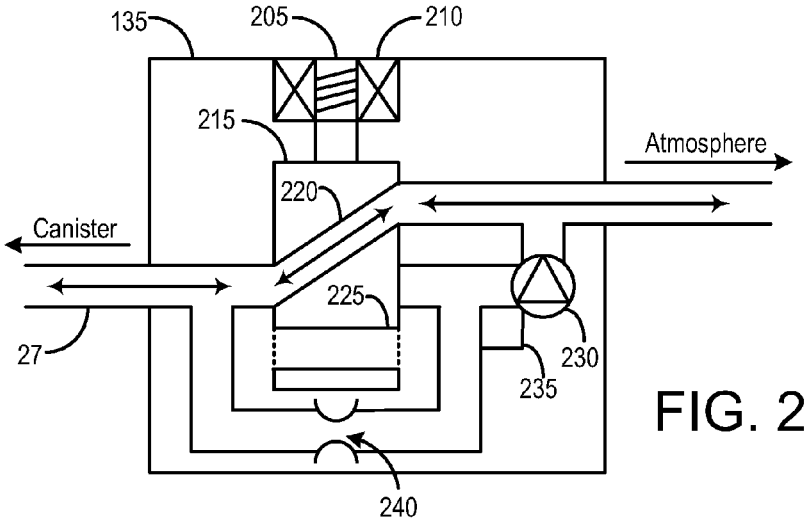
FIG. 2C shows a schematic depiction of an evaporative leak check module in a configuration to perform a purge operation.

FIGS. 2A-2C show a schematic depiction of an example ELCM 135 in various conditions in accordance with the present disclosure. As shown in FIG. 1, ELCM 135 may be located along vent 27 between canister vent valve 114 and atmosphere. ELCM 135 includes a changeover valve (COV) 215, a pump 230, and a pressure sensor 235. Pump 230 may be a vane pump. COV 215 may be moveable between a first a second position. In the first position, as shown in FIGS. 2A and 2C, air may flow through ELCM 135 via first flow path 220. In the second position, as shown in FIG. 2B, air may flow through ELCM 135 via second flow path 225. The position of COV 215 may be controlled by solenoid 210 via compression spring 205. ELCM may also comprise reference orifice 240. Reference orifice 240 may have a diameter corresponding to the size of a threshold leak to be tested, for example, 0.02". In either the first or second position, pressure sensor 235 may generate a pressure signal reflecting the pressure within ELCM 135. Operation of valve 230 and solenoid 210 may be controlled via signals received from controller 12.

As shown in FIG. 2A, COV 215 is in the first position, and pump 230 is activated. Canister vent valve 114 (not shown) is closed, isolating ELCM 135 from the canister and fuel tank. Air flow through ELCM 135 in this configuration is represented by arrows. In this configuration, pump 230 may draw a vacuum on reference orifice 240, and pressure sensor 235 may record the vacuum level within ELCM 135. This reference check vacuum level reading may then become the threshold for passing/failing a subsequent leak test.

As shown in FIG. 2B, COV 215 is in the second position, and pump 230 is activated. Canister vent valve 114 (not shown) is open, allowing pump 230 to draw a vacuum on fuel system 18. In examples where fuel system 18 includes FTIV 110, FTIV 110 may be opened to allow pump 230 to draw a vacuum on fuel tank 20. Air flow through ELCM 135 in this configuration is represented by arrows. In this configuration, as pump 230 pulls a vacuum on fuel system 18, the absence of a leak in the system should allow for the vacuum level in ELCM 135 to reach or exceed the previously determined vacuum threshold. In the presence of a leak larger than the reference orifice, the pump will not pull down to the reference check vacuum level.

As shown in FIG. 2C, COV 215 is in the first position, and pump 230 is de-activated. Canister vent valve 114 is open, allowing for air to freely flow between atmosphere and the canister, such as during a canister purging operation.

By using an internal reference orifice, ELCM 135 automatically calibrates for noise factors such as humidity, ambient temperature, and barometric pressure. However, one noise factor that is not calibrated for is the Reid Vapor Pressure (RVP) of the fuel in fuel tank 20. A fuel with a high RVP may counteract the vacuum pull of pump 230. In such a scenario, the vacuum reading taken during a leak check may not reach the reference threshold, mimicking a leak, even in the presence of an intact fuel system. This may result in a false failure of the ELCM test. By taking advantage of hydrocarbon sensor 130 coupled to conduit 31, fuel RVP may be estimated, and the reference threshold adjusted accordingly. This may increase the accuracy of the ELCM test and reduce the number of false fail events.

Figure 3:
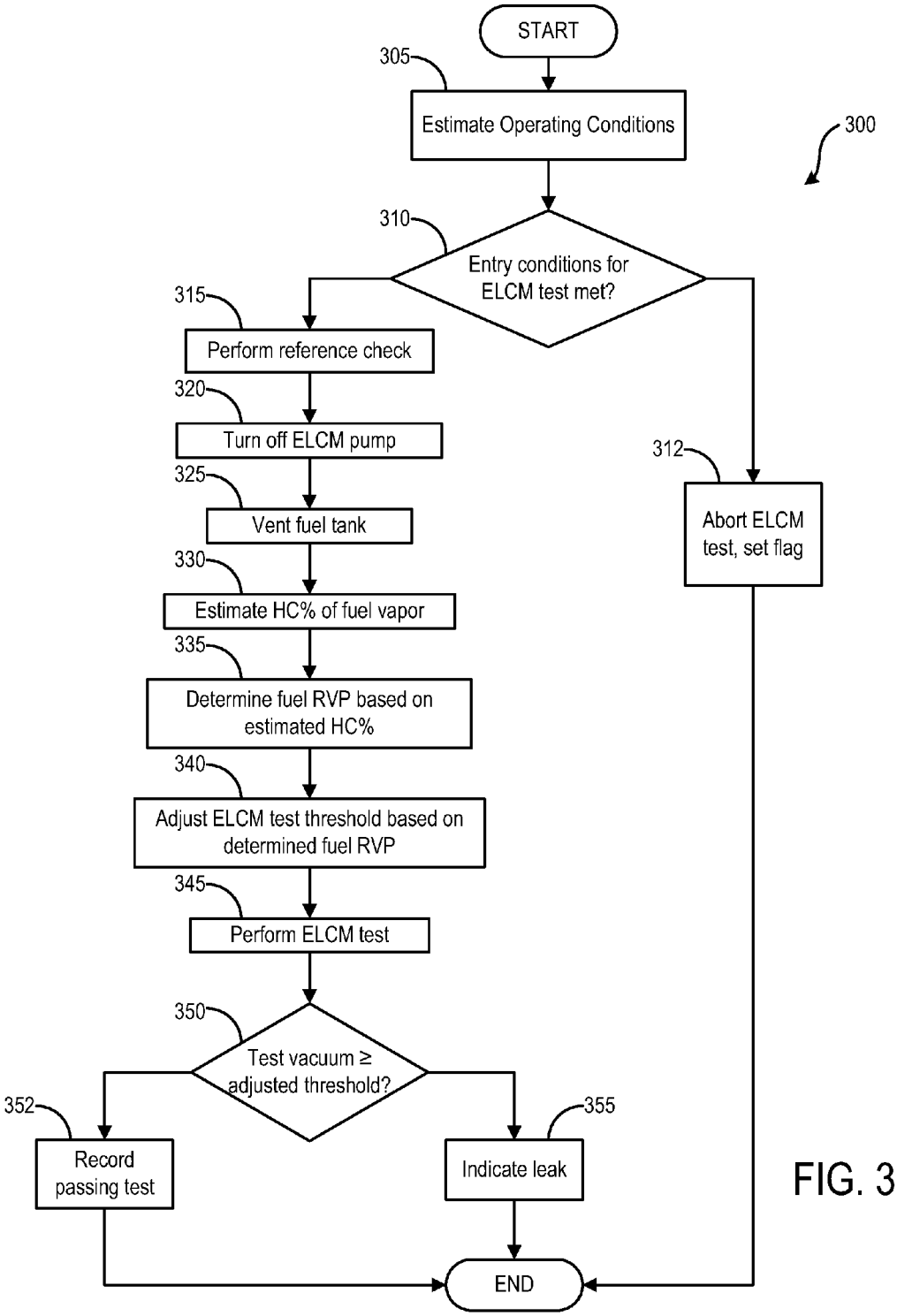
FIG. 3 shows a high level flow chart for a method that may be implemented for performing an evaporative leak check module test.
Figure 4A:
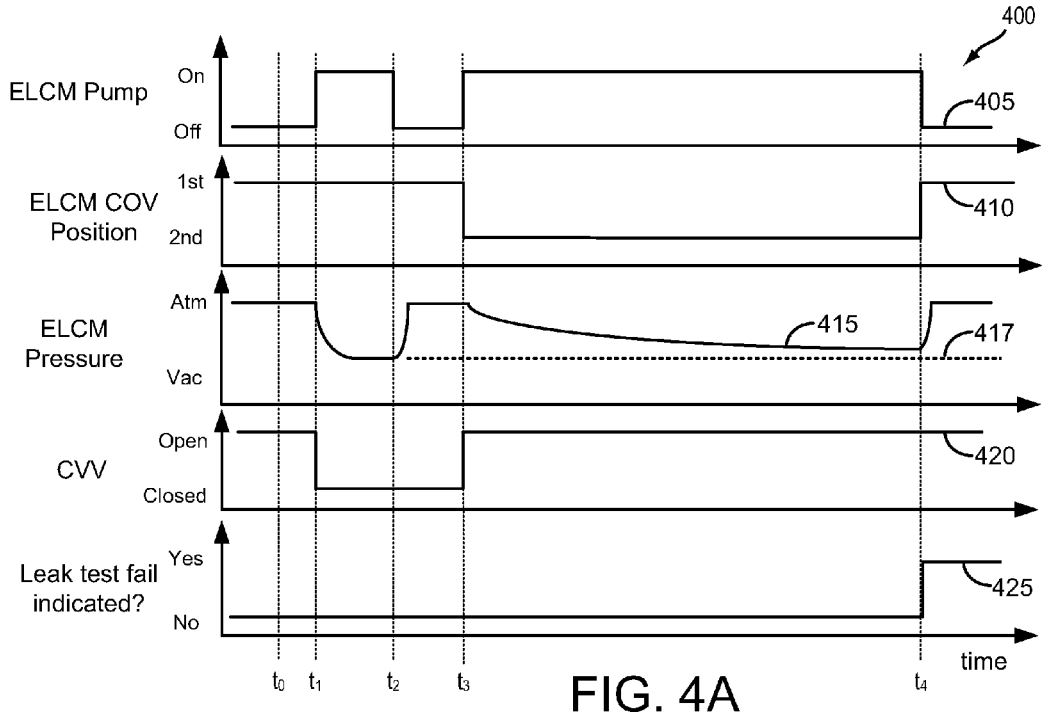
FIG. 4A shows a timeline for an example evaporative leak check module test.
Figure 4B:
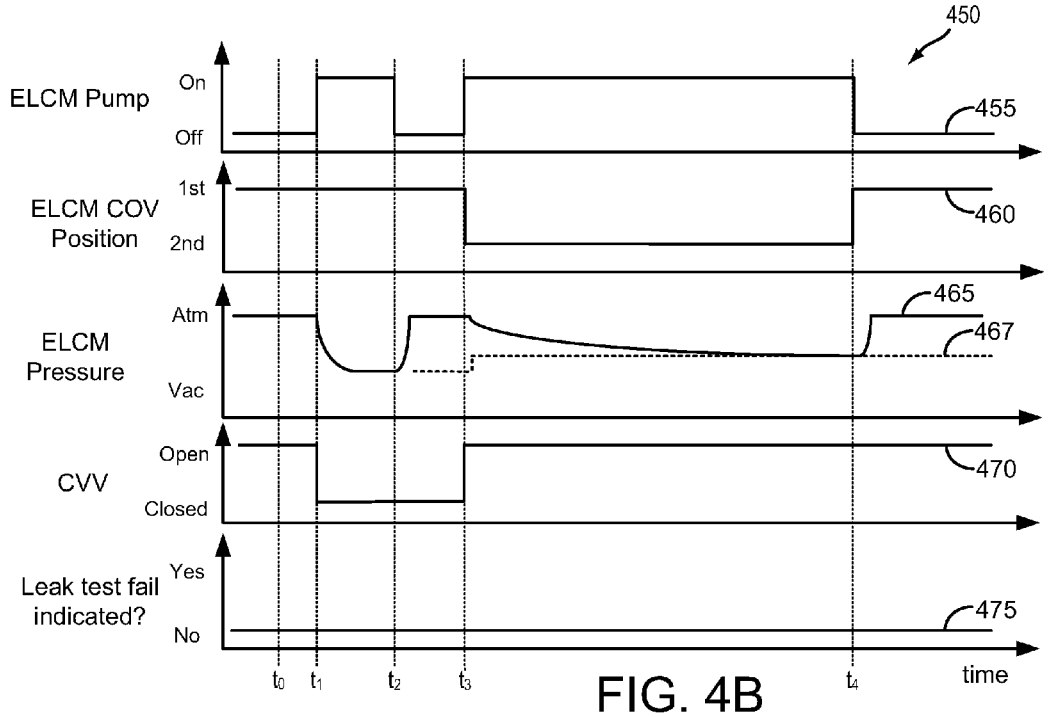
FIG. 4B shows a timeline for an example evaporative leak check module test.

FIG. 3 shows a high-level flow chart for an example method 300 for performing an ELCM test in accordance with the current disclosure. Method 300 will be described with relation to the systems depicted in FIGS. 1 and 2, but it should be understood that similar methods may be used with other systems without departing from the scope of this disclosure. Method 300 may be carried out by controller 12.

Method 300 may begin at 305 by estimating operating conditions. Operating conditions may include ambient conditions, such as temperature, humidity, and barometric pressure, as well as vehicle conditions, such as engine operating status, fuel level. Continuing at 310, method 300 may include determining whether the entry conditions for an ELCM test are met. Entry conditions for an ELCM test may include an engine-off status, and/or determining that the fuel system is not undergoing a purge operation. If entry conditions are not met, method 300 may proceed to 312. At 312, method 300 may include recording that an ELCM test was aborted, and may further include setting a flag to retry the ELCM test at a later time point.

If entry conditions for an ELCM test are met, method 300 may proceed to 315. At 315, method 300 may include performing an ELCM reference check. As discussed herein with regards to FIG. 2A, an ELCM reference check may comprise closing (or maintaining closed) a canister vent valve, placing a COV in a first position, and activating an ELCM vacuum pump. A pressure sensor, such as pressure sensor 235 may record the resulting vacuum level in the ELCM, after a certain amount of time, or when the vacuum level has reached a plateau.

Continuing at 320, method 300 may include turning off the ELCM pump. Method 300 may further comprise allowing the pressure in ELCM 135 to return to atmospheric pressure. Continuing at 325, method 300 may include venting the fuel tank. Venting the fuel tank may include opening a fuel tank isolation valve, such as FTIV 110. Venting the fuel tank will result in fuel vapor stored in the fuel tank to enter canister 22 via conduit 31.

Continuing at 330, method 300 may include estimating the hydrocarbon percentage of the fuel vapor vented at 325. As fuel vapor travels from the fuel tank to the fuel vapor canister via conduit 31, it will pass hydrocarbon sensor 130. The hydrocarbon sensor may then output a signal representing the percentage of hydrocarbons contained in the fuel vapor. Continuing at 335, method 300 may include determining a fuel RVP based on the estimated hydrocarbon percentage. The fuel RVP may be further based on fuel tank fill level, ambient temperature, barometric pressure, etc. The fuel RVP may be determined empirically or through a look-up table stored in controller 12.

Continuing at 340, method 300 may include adjusting an ELCM test threshold based on the determined fuel RVP. For example, in the presence of a fuel with a relatively high RVP, the expected vacuum upon an ELCM test may be less than for a fuel with a relatively low RVP. The adjusted ELCM test threshold may be determined through a lookup table stored in controller 12. In this way, ELCM test false failures due to high RVP fuel vapor counteracting ELCM vacuum may be reduced. If the fuel RVP is below a threshold, the ELCM test threshold may not be adjusted significantly.

Following the adjustment of the ELCM test threshold, method 300 may proceed to 345. At 345, method 300 may include performing an ELCM test. As described herein and with regards to FIG. 2B, an ELCM test may include placing COV 215 in the second position, and activating pump 230. Canister vent valve 114 may be open, allowing pump 230 to draw a vacuum on fuel system 18. In examples where fuel system 18 includes FTIV 110, FTIV 110 may be opened to allow pump 230 to draw a vacuum on fuel tank 20. In this configuration, as pump 230 pulls a vacuum on fuel system 18, the absence of a leak in the system should allow for the vacuum level in ELCM 135 to reach or exceed the previously determined vacuum threshold. In the presence of a leak larger than the reference orifice, the pump will not pull down to the reference check vacuum level. Following the ELCM test, method 300 may include de-activating pump 230, de-energizing solenoid 210, and may further include closing CVV 114 and/or FTIV 110.

Continuing at 350, method 300 may include determining whether the test vacuum acquired during the ELCM test is greater than or equal to the adjusted ELCM test threshold. If the test vacuum acquired during the ELCM test is greater than or equal to the adjusted ELCM test threshold, method 300 may proceed to 352. At 352, method 300 may include recording the occurrence of a passing ELCM test result. Method 300 may then end.

If test vacuum acquired during the ELCM test is not greater than or equal to the adjusted ELCM test threshold, method 300 may proceed to 355. At 355, method 300 may include indicating the presence of a leak in fuel system 18. Indicating the presence of a leak may include recording the occurrence of a failing test result, and may further include illuminating an MIL. Method 300 may then end.

The systems described herein and depicted in FIGS. 1 and 2, along with the method described herein and depicted in FIG. 3 may enable one or more methods. In one example, a method for an evaporative emissions system leak test, comprising: determining a reference vacuum threshold; venting fuel vapor from a fuel tank; determining a fuel Reid Vapor Pressure of the fuel vapor; adjusting the reference vacuum threshold based on the fuel Reid Vapor Pressure; drawing a vacuum on a fuel tank with an evaporative leak check module; and indicating degradation of the evaporative emissions system based on the adjusted reference vacuum threshold. Determining the reference vacuum threshold may further comprise: isolating an evaporative leak check module from the fuel tank; activating a vacuum pump comprising the evaporative leak check module; drawing a vacuum across a reference orifice; and determining a reference vacuum in the evaporative leak check module. Determining a fuel Reid Vapor Pressure of the fuel vapor may further comprise: venting fuel vapor from the fuel tank to a fuel vapor canister; determining a hydrocarbon percentage of the fuel vapor with a hydrocarbon sensor coupled between the fuel tank and the fuel vapor canister; and determining a fuel Reid Vapor Pressure based on the hydrocarbon percentage of the fuel vapor. Indicating degradation of the evaporative emissions system based on the adjusted reference vacuum threshold may further comprise: coupling the evaporative leak check module to the fuel tank; activating the vacuum pump; and determining a resulting vacuum in the fuel tank. The method may further comprise: indicating degradation of the evaporative emissions system if the resulting vacuum in the fuel tank is less than the adjusted reference vacuum threshold. The technical result of implementing this method is an evaporative leak check module based test with fewer false failure results. In a fuel system using a fuel with a high Reid Vapor Pressure, the fuel vapor may counteract the vacuum pull of an evaporative leak check module. As such, the resulting test vacuum may not reach the expected reference vacuum threshold, indicating a leak in the fuel system even if the system is intact. By compensating for the fuel Reid Vapor Pressure, an accurate reference vacuum threshold may be determined, resulting in a more accurate test with fewer false failures, thereby reducing unnecessary warranty service and reducing producer risk.

FIG. 4A shows an example timeline 400 for an evaporative leak check module test using the method described herein and with regards to FIG. 3 applied to the system described herein and with regards to FIGS. 1 and 2, but without compensating for fuel RVP. Timeline 400 includes plot 405 indicating the status of an ELCM pump time. Timeline 400 also includes plot 410 indicating the position of an ELCM change-over valve over time. Timeline 400 also includes plot 415, indicating the pressure within the ELCM over time, plot 420, indicating the status of a canister vent valve over time, and plot 425, indicating whether a leak test fail is indicated. Line 417 represents a pressure threshold for an ELCM pressure.

At time $t_0$, the ELCM pump is off, as shown by plot 405. The ELCM COV is in the $1^{st}$ position, as shown by plot 410, and the CVV is open, as shown by plot 420. As such, the ELCM pressure is at atmosphere, as shown by plot 415, and no leak test fail is indicated, as shown by plot 425.

At time $t_1$, entry conditions are met for an ELCM test. The reference check portion of the ELCM test thus begins at time $t_1$. The CVV is closed, as shown by plot 420, isolating the ELCM from the fuel system. The ELCM pump is then turned on, as shown by plot 405, while maintaining the ELCM COV in the $1^{st}$ position, drawing a vacuum on the ELCM reference orifice. In response, a vacuum develops in the ELCM, as shown by plot 415. By time $t_2$, the ELCM pressure has stabilized. This vacuum value is recorded and used to establish a reference threshold, as shown by plot 417. The ELCM pump is then turned off, as shown by plot 405, allowing the ELCM pressure to return to atmosphere, as shown by plot 415.

At time $t_3$, the ELCM begins the test portion of the ELCM test. The CVV is opened, as shown by plot 420, coupling the ELCM to the fuel system. In examples where the fuel system includes an FTIV, the FTIV may also be opened at time $t_3$. The ELCM pump is then turned on, as shown by plot 405, while the ELCM COV is placed in the $2^{nd}$ position, as shown by plot 410. This allows the ELCM pump to draw vacuum on the fuel system. In response, a vacuum develops in the fuel system, and accordingly, a vacuum develops in the ELCM, as shown by plot 415.

At time $t_4$, the ELCM pressure reaches a plateau. The vacuum in the ELCM at time t4 is less than the reference vacuum, as shown by plots 415 and 417. As such, a leak test fail is indicated, as shown by plot 425. The ELCM pump may then be shut off, as shown by plot 405, and the ELCM COV may be returned to the $1^{st}$ position, as shown by plot 410. Accordingly, the ELCM pressure returns to atmosphere. The ELCM test may then end.

FIG. 4B shows an example timeline 450 for an evaporative leak check module test using the method described herein and with regards to FIG. 3 applied to the system described herein and with regards to FIGS. 1 and 2, including compensation for fuel RVP. Timeline 450 includes plot 455 indicating the status of an ELCM pump time. Timeline 450 also includes plot 460 indicating the position of an ELCM change-over valve over time. Timeline 450 also includes plot 465, indicating the pressure within the ELCM over time, plot 470, indicating the status of a canister vent valve over time, and plot 475, indicating whether a leak test fail is indicated. Line 467 represents a pressure threshold for an ELCM pressure.

Vehicle conditions and ambient conditions may be considered identical to those depicted in FIG. 6A. As such, FIG. 4B mirrors FIG. 4A from time $t_0$ through time $t_2$. By time $t_2$, the ELCM pressure has stabilized. This vacuum value is recorded and used to establish a reference threshold, as shown by plot 467. The ELCM pump is then turned off, as shown by plot 455, allowing the ELCM pressure to return to atmosphere, as shown by plot 465.

At time $t_3$, the ELCM begins the test portion of the ELCM test. The CVV is opened, as shown by plot 470, coupling the ELCM to the fuel system. In examples where the fuel system includes an FTIV, the FTIV may also be opened at time $t_3$. Opening the CVV further allows fuel vapor to engage a hydrocarbon sensor coupled to a conduit between the fuel tank and the canister. As described herein and with regard to FIG. 3, a hydrocarbon sensor reading taken during fuel tank venting may be used to determine a fuel RVP, which in turn may be used to establish an adjusted threshold for the test portion of the ELCM test. This adjustment is shown by plot 467 following time $t_3$.

The ELCM pump is then turned on, as shown by plot 455, while the ELCM COV is placed in the $2^{nd}$ position, as shown by plot 460. This allows the ELCM pump to draw vacuum on the fuel system. In response, a vacuum develops in the fuel system, and accordingly, a vacuum develops in the ELCM, as shown by plot 465.

At time $t_4$, the ELCM vacuum reaches the reference vacuum, as shown by plots 465 and 467. As such, the ELCM test passes, and no leak test fail is indicated, as shown by plot 475. This is in contrast with the ELCM test depicted in FIG. 4A, where the ELCM test failed. The ELCM pump is then turned off, as shown by plot 455 and the ELCM COV is returned to the $1^{st}$ position, as shown by plot 460. Accordingly, the ELCM pressure returns to atmospheric, as shown by plot 465. The ELCM test may then end.

Similar to an ELCM test, an engine-off natural vacuum (EONV) test may be confounded if fuel RVP is not compensated for. During the pressure-rise portion of an EONV test, a high RVP fuel may produce a pressure rise greater than a threshold pressure based on fuel tank fill level, ambient temperature, etc., even in the presence of a fuel system leak. This may result in false-pass test results.

Figure 5:
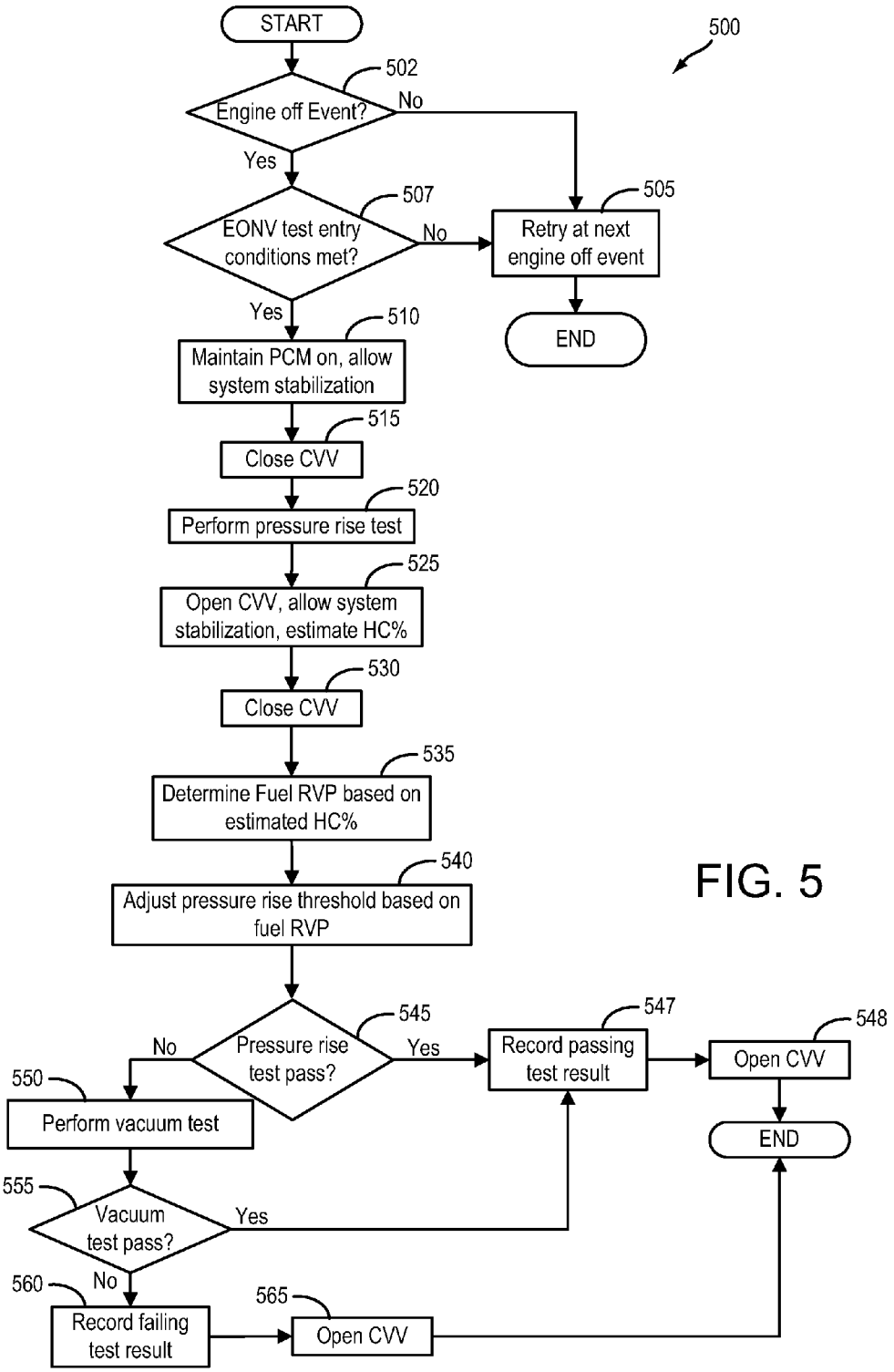
FIG. 5 shows a high level flow chart for a method that may be implemented for performing an engine-off natural vacuum test.
Figure 6A:
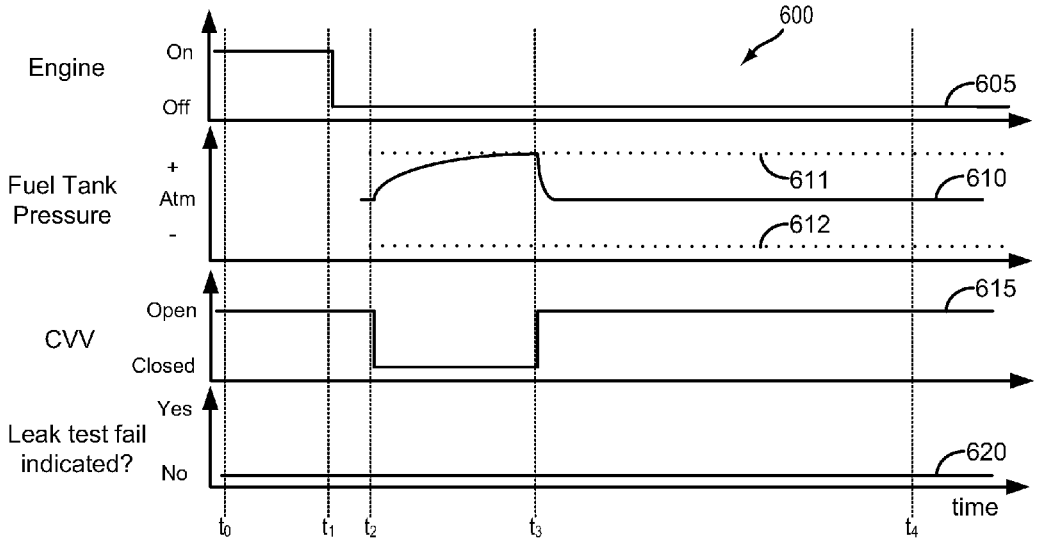
FIG. 6A shows a timeline for an example engine-off natural vacuum test.
Figure 6B:
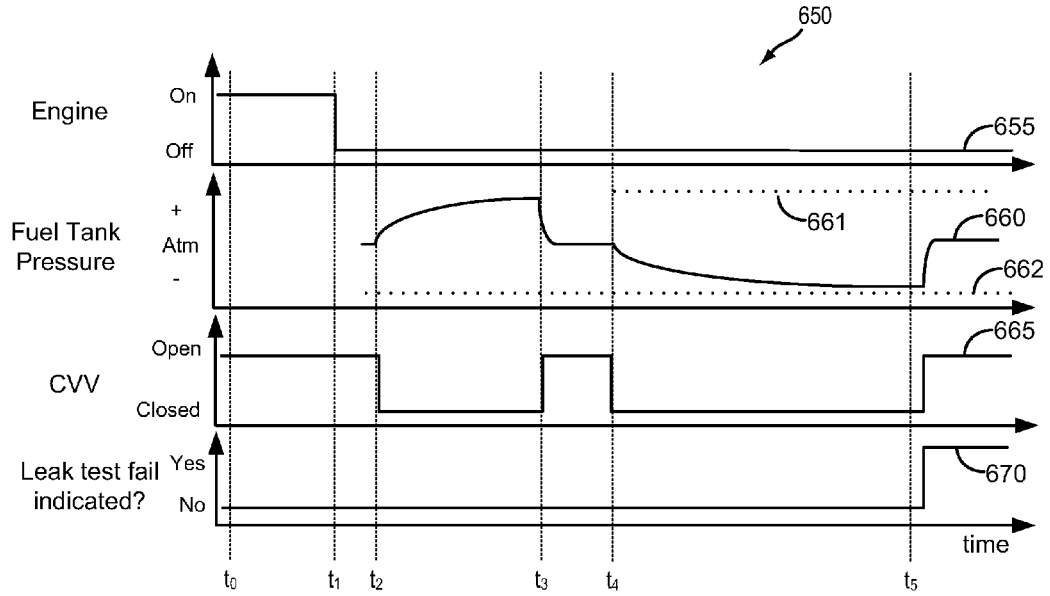
FIG. 6B shows a timeline for an example engine-off natural vacuum test.

FIG. 5 depicts a high-level method 500 for an engine-off natural vacuum test. Method 500 will be described with relation to the systems depicted in FIG. 1, but it should be understood that similar methods may be used with other systems without departing from the scope of this disclosure. Method 500 may be carried out by controller 12.

Method 500 may begin at 502. At 502, method 500 may include determining whether an engine-off event has occurred. If no engine-off event is detected, method 500 may proceed to 505. At 505, method 500 may include recording that an EONV test was aborted, and setting a flag to retry the EONV test at the next detected engine-off event. Method 500 may then end. If an engine-off event is detected, method 500 may proceed to 507.

At 507, method 500 may include determining whether entry conditions for an EONV test are met. Entry conditions may include a threshold amount of time passed since the previous EONV test, a threshold length of engine run time prior to the engine-off event, a threshold amount of fuel in the fuel tank, and a threshold battery state of charge. For hybrid electric, plugin-hybrid electric, and other vehicles capable of being powered during an engine-off event, the entry conditions may also include a vehicle-off condition. If entry conditions are not met, method 500 may proceed to 505. At 505, method 500 may include recording that an EONV test was aborted, and setting a flag to retry the EONV test at the next detected engine-off event. Method 500 may then end. If entry conditions are met, method 500 may proceed to 510.

Although entry conditions may be met at the beginning of method 500, this may change during the execution of the method. For example, an engine restart or refueling event may be sufficient to abort the method at any point prior to completing method 500. If such events are detected that would interfere with the performing of method 500 or the interpretation of results derived from executing method 500, method 500 may proceed to 505, record that an EONV test was aborted, and set a flag to retry the EONV test at the next detected engine-off event, and then end.

Continuing at 510, method 500 may include maintaining the PCM on despite the engine-off and/or vehicle off condition. In this way, the method may continue to be carried out by controller 12. Method 500 may further include allowing the fuel system to stabilize following the engine-off condition. Allowing the fuel system to stabilize may include waiting for a period of time before method 500 advances. The stabilization period may be a pre-determined amount of time, or may be an amount of time based on current operating conditions. In some examples, the stabilization period may be characterized as the length of time necessary for consecutive measurements of a parameter to be within a threshold of each other. For example, fuel may be returned to the fuel tank from other fuel system components following an engine off condition. The stabilization period may thus end when two or more consecutive fuel level measurements are within a threshold amount of each other, signifying that the fuel level in the fuel tank has reached a steady-state. In some examples, the stabilization period may end when the fuel tank pressure is equal to atmospheric pressure. Following the stabilization period, method 500 may proceed to 515.

At 515, method 500 may include closing a canister vent valve (CVV). Additionally or alternatively, a fuel tank isolation valve (FTIV) may be closed where included in the fuel system. In this way, the fuel tank may be isolated from atmosphere. The status of a canister purge valve (CPV) and/or other valves coupled within a conduit connecting the fuel tank to atmosphere may also be assessed and closed if open. Method 500 may then proceed to 520.

At 520, method 500 may include performing a pressure rise test. While the engine is still cooling down post shutdown, there may be additional heat rejected to the fuel tank. With the fuel system sealed via the closing of the CVV, the pressure in the fuel tank may rise due to fuel volatizing with increased temperature. The pressure rise test may include monitoring fuel tank pressure for a period of time. Fuel tank pressure may be monitored until the pressure reaches a threshold, the threshold pressure indicative of no leaks above a threshold size in the fuel tank. The threshold pressure may be based on the current conditions, including the ambient temperature, the fuel level, the fuel volatility, etc. In some examples, the rate of pressure change may be compared to an expected rate of pressure change. The fuel tank pressure may not reach the threshold pressure. Rather the fuel tank pressure may be monitored for a predetermined amount of time, or an amount of time based on the current conditions. The fuel tank pressure may be monitored until consecutive measurements are within a threshold amount of each other, or until a pressure measurement is less than the previous pressure measurement. The fuel tank pressure may be monitored until the fuel tank temperature stabilizes. Method 500 may then proceed to 525.

At 525, method 500 may include opening the CVV and allowing the system to stabilize. Opening the CVV allows the fuel tank pressure to return to atmospheric pressure. The system may be allowed to stabilize until the fuel tank pressure reaches atmospheric pressure, or until consecutive pressure readings are within a threshold of each other. Method 500 may also include estimating the hydrocarbon percentage of the fuel vapor vented to the canister. As fuel vapor travels from the fuel tank to the fuel vapor canister via conduit 31, it will pass hydrocarbon sensor 130. The hydrocarbon sensor may then output a signal representing the percentage of hydrocarbons contained in the fuel vapor. Following system stabilization, method 500 may proceed to 530. At 530, method 500 may include closing the CVV. In this way, the fuel tank may be isolated from atmosphere. As the fuel tank cools, the fuel vapors should condense into liquid fuel, creating a vacuum within the sealed tank.

Continuing at 535, method 500 may include determining a fuel RVP based on the estimated hydrocarbon percentage. The fuel RVP may be further based on fuel tank fill level, ambient temperature, barometric pressure, etc. The fuel RVP may be determined empirically or through a look-up table stored in controller 12.

Continuing at 540, method 500 may include adjusting a pressure rise threshold based on the determined fuel RVP. For example, in the presence of a fuel with a relatively high RVP, the expected pressure during the pressure rise portion of an EONV test may be higher than for a fuel with a relatively low RVP. The adjusted EONV test threshold may be determined through a lookup table stored in controller 12. In this way, EONV test false passes due to high RVP fuel vapor producing additional fuel tank pressure may be reduced. If the fuel RVP is below a threshold, the EONV test threshold may not be adjusted significantly.

Continuing at 545, method 500 may include determining whether the pressure rise test resulted in a passing test result. Determining whether the pressure rise test resulted in a passing test result may include comparing the peak pressure attained during the pressure rise test to the adjusted pressure rise threshold based on the determined fuel RVP. If the peak pressure attained during the pressure rise test is greater than or equal to the adjusted pressure rise threshold, the pressure rise test may result in a passing test. Method 500 may then proceed to 547. At 547, method 500 may include recording the passing test result. Continuing at 548, method 500 may include opening the canister vent valve. In this way, the fuel tank pressure may be returned to atmospheric pressure. Method 500 may then end.

If the peak pressure attained during the pressure rise test is less than the adjusted pressure rise threshold, the pressure rise test may not result in a passing test. Method 500 may then proceed to 550. At 550, method 500 may include performing a vacuum test. Performing a vacuum test may include monitoring fuel tank pressure for a period of time. Fuel tank pressure may be monitored until the vacuum reaches a threshold, the threshold vacuum indicative of no leaks above a threshold size in the fuel tank. The threshold vacuum may be based on the current conditions, including the ambient temperature, the fuel level, the fuel volatility, etc. In some examples, the rate of pressure change may be compared to an expected rate of pressure change. The fuel tank pressure may not reach the threshold vacuum. Rather the fuel tank pressure may be monitored for a predetermined amount of time, or an amount of time based on the current conditions. In some embodiments, the vacuum threshold may be adjusted based on the RVP of the fuel, as determined at 535. For example, given a highly volatile fuel at cool ambient temperatures, a vacuum may develop in the fuel tank that is greater than what is expected for a given fuel tank fill level, even in the presence of a leak in the fuel system, due to the condensing of the highly volatile fuel. This may result in a false pass result.

Continuing at 555, method 500 may include determining whether a passing result was indicated for the vacuum test, such as the fuel tank vacuum reaching a pressure threshold. If the vacuum test resulted in a passing result, method 500 may proceed to 547. At 547, method 500 may include recording the passing test result. Continuing at 548, method 500 may include opening the canister vent valve. If the cooling fans were turned on to assist fuel tank vacuum development, they may be shut off. In this way, the fuel tank pressure may be returned to atmospheric pressure. Method 500 may then end.

If the vacuum test did not result in a passing result, method 500 may proceed to 560. At 560, method 500 may include recording the failing test result. Continuing at 560, method 500 may include opening the canister vent valve. In this way, the fuel tank pressure may be returned to atmospheric pressure. If the cooling fans were turned on to assist fuel tank vacuum development, they may be shut off. Method 500 may then end.

The system described herein and depicted in FIG. 1, along with the method described herein and depicted in FIG. 5 may enable one or more methods. In one example, a method for an evaporative emissions system leak test, comprising: responsive to an engine off condition, closing a canister vent valve; determining a resulting pressure of a fuel tank; determining a Reid Vapor Pressure of a fuel in the fuel tank; determining a threshold pressure based on the fuel Reid Vapor Pressure; and comparing the resulting pressure of the fuel tank to the threshold pressure. Determining a Reid Vapor Pressure of a fuel in the fuel tank may further comprise: opening the canister vent valve; determining a hydrocarbon percentage of a fuel vapor in the fuel tank; and determining the Reid Vapor Pressure of the fuel in the fuel tank based on the hydrocarbon percentage of the fuel vapor. The method may further comprise: responsive to the resulting pressure of the fuel tank being greater than the threshold pressure, indicating no degradation of the fuel tank. The method may further comprise: responsive to the resulting pressure of the fuel tank being less than the threshold pressure, closing the canister vent valve; and comparing a resulting fuel tank vacuum to a vacuum threshold. The technical result of implementing this method is an engine-off natural vacuum test that is less prone to false pass results. In a fuel system using a fuel with a high Reid Vapor Pressure, the fuel vapor may result in an increased fuel tank pressure during the pressure rise portion of the test. This may indicate an intact fuel system, when in fact the fuel system is degraded. By compensating for the fuel Reid Vapor Pressure, an accurate pressure threshold may be determined, resulting in a more accurate test with fewer false passes, thereby reducing consumer risk.

FIG. 6A shows an example timeline 600 for an engine-off natural vacuum test using the method described herein and with regards to FIG. 5, but without compensating for fuel RVP. Timeline 600 includes plot 605 indicating the status of an engine over time. Timeline 600 also includes plot 610 indicating the pressure inside a fuel tank over time. Timeline 600 also includes plot 615, indicating the status of a canister vent valve (CVV) over time, and plot 620, indicating whether a leak test fail is indicated. Line 611 represents a pressure rise threshold for fuel tank pressure. Line 612 represents a vacuum threshold for fuel tank pressure.

At $t_0$, the vehicle engine is on, as shown by plot 605. Accordingly, the CVV is open, as shown by plot 615. At time $t_1$, the vehicle engine is shut off, as shown by plot 605. Entry conditions for an EONV test are met, and the test proceeds.

From time $t_1$ to time $t_2$, the temperature and pressure of the fuel system are allowed to stabilize. At time $t_2$, the CVV is closed, sealing the system, as shown by plot 615. The EONV test may then begin with the pressure rise portion of the test. In this example, the pressure rise threshold 611 is determined based on vehicle and ambient conditions, and is established at time $t_1$. Heat may continue to be rejected into the gas tank following engine shutoff. The fuel tank pressure thus continues to rise from $t_2$ to $t_3$. At $t_3$, the fuel tank pressure reaches the pressure rise threshold, depicted by line 611. This signifies a passing leak test. Accordingly, a leak test fail is not indicated, as shown by plot 620. The CVV is opened to vent the system. As such, the fuel tank pressure drops to atmospheric pressure, as shown by plot 610. With the pressure rise test passing, there is no need to perform the vacuum portion of the EONV test. The test is thus completed in advance of the test run time limit, shown at $t_4$.

FIG. 6B shows an example timeline 650 for an engine-off natural vacuum test using the method described herein and with regards to FIG. 5, including compensation for fuel RVP. Timeline 650 includes plot 655 indicating the status of an engine over time. Timeline 650 also includes plot 660 indicating the pressure inside a fuel tank over time. Timeline 650 also includes plot 665, indicating the status of a canister vent valve (CVV) over time, and plot 670, indicating whether a leak test fail is indicated. Line 661 represents a pressure rise threshold for fuel tank pressure. Line 662 represents a vacuum threshold for fuel tank pressure.

Vehicle conditions and ambient conditions may be considered identical to those depicted in FIG. 6A. As such, FIG. 6B mirrors FIG. 6A from time $t_0$ through time $t_2$. At time $t_2$, the CVV is closed, sealing the system, as shown by plot 615. The EONV test may then begin with the pressure rise portion of the test. Heat may continue to be rejected into the gas tank following engine shutoff. The fuel tank pressure thus continues to rise from $t_2$ to $t_3$. At $t_3$, the fuel tank pressure reaches a plateau, signifying the end of the pressure rise portion of the test. The pressure at time $t_3$ is recorded, and the CVV is opened, as shown by plot 665. Opening the CVV allows the fuel system to vent, and causes the fuel tank pressure to decrease to atmospheric pressure. When the fuel tank pressure has stabilized, at $t_4$, the CVV is again closed, sealing the system in preparation for the vacuum portion of the EONV test. As the fuel tank cools, a vacuum should develop in the absence of system leaks.

Opening the CVV further allows fuel vapor to engage a hydrocarbon sensor coupled to a conduit between the fuel tank and the canister. As described herein and with regard to FIG. 5, a hydrocarbon sensor reading taken during fuel tank venting may be used to determine a fuel RVP, which in turn may be used to establish an adjusted threshold for the pressure rise portion of the EONV test. Accordingly, a threshold is determined at time $t_4$, as shown by plot 661. The fuel tank pressure recorded at time $t_3$ may thus be compared to the threshold determined at time $t_4$. In this example, the fuel tank pressure recorded at time $t_3$ is less than the threshold determined at time $t_4$. The EONV test then proceeds to the vacuum test portion. This is in contrast to the example depicted in FIG. 6A, where the pressure rise portion of the EONV test ended in a passing test result.

The fuel tank pressure drops from time $t_4$ to time $t_5$, as the cooling fuel condenses and forms a vacuum in the fuel tank, as shown by plot 660. At time $t_5$, the EONV test reaches a time limit. The time limit may be based on the stored battery charge available at the beginning of the EONV test, as closing the CVV drains the battery in order to energize the canister vent solenoid. At time $t_5$, the fuel tank pressure is greater than the threshold shown by plot 662. As such, a leak test fail is indicated, as shown by plot 670. The CVV is opened, as shown by plot 665, allowing the fuel tank pressure to return to atmospheric pressure, as shown by plot 660. The EONV test may then end.

The systems described herein and depicted in FIGS. 1 and 2, along with the methods described herein and depicted in FIGS. 3 and 5 may enable one or more methods. In one example, a method for an evaporative emissions leak test, comprising: adjusting a pressure threshold based on a fuel volatility of a fuel contained in a fuel tank; and performing the evaporative emissions leak test based on the adjusted pressure threshold. The fuel volatility may be determined by: venting fuel vapor from the fuel tank to a fuel vapor canister; and determining a hydrocarbon percentage of the vented fuel vapor with a hydrocarbon sensor coupled between the fuel tank and the fuel vapor canister. The method may further comprise: determining a fuel Reid Vapor Pressure based on the determined hydrocarbon percentage of the vented fuel vapor. The evaporative emissions leak test may be an engine-off natural vacuum test, and performing the evaporative emissions leak test may further include indicating degradation based on comparing a fuel tank pressure to the adjusted pressure threshold. The adjusted pressure threshold may be a threshold for a fuel tank pressure rise portion of the engine-off natural vacuum test. The method may thus further comprise: responsive to the fuel tank pressure being less than the adjusted pressure threshold following the fuel tank pressure rise portion of the engine-off natural vacuum test, performing a vacuum portion of the engine-off natural vacuum test. The method may further comprise: responsive to a fuel tank vacuum being less than a vacuum threshold following the vacuum portion of the engine-off natural vacuum test, indicating an evaporative emissions system leak. In some embodiments, the evaporative emissions leak test may be an evaporative leak check module based test. The method may thus further comprise: isolating an evaporative leak check module from the fuel tank; activating a vacuum pump comprising the evaporative leak check module; drawing a vacuum across a reference orifice; and setting a pressure threshold based on the vacuum drawn across the reference orifice. The method may further comprise: coupling the evaporative leak check module to the fuel tank; activating the vacuum pump; and drawing a vacuum on the fuel tank. The method may further comprise: responsive to a fuel tank pressure being greater than the pressure threshold, indicating an evaporative emissions system leak. The technical result of implementing this method is an evaporative emissions leak test that is robust and accurate and results in fewer diagnostic failures due to fuel volatility. By using an existing hydrocarbon sensor in the fuel system, both consumer risk and producer risk related to misdiagnosis of fuel system leaks may be reduced without requiring the addition of components to the fuel system.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an evaporative emissions leak test, comprising:

adjusting a pressure threshold based on a fuel volatility of a fuel contained in a fuel tank; and performing the evaporative emissions leak test based on the adjusted pressure threshold, where the fuel volatility is determined by:

venting fuel vapor from the fuel tank to a fuel vapor canister; and determining a hydrocarbon percentage of the vented fuel vapor with a hydrocarbon sensor coupled between the fuel tank and the fuel vapor canister.

2. The method of claim 1, further comprising:

determining a fuel Reid Vapor Pressure based on the determined hydrocarbon percentage of the vented fuel vapor.

3. The method of claim 1, where the evaporative emissions leak test is an engine-off natural vacuum test, and where performing the evaporative emissions leak test further includes indicating degradation based on comparing a fuel tank pressure to the adjusted pressure threshold.

4. The method of claim 3, where the adjusted pressure threshold is a threshold for a fuel tank pressure rise portion of the engine-off natural vacuum test.

5. The method of claim 4, further comprising:

responsive to the fuel tank pressure being less than the adjusted pressure threshold following the fuel tank pressure rise portion of the engine-off natural vacuum test, performing a vacuum portion of the engine-off natural vacuum test.

6. The method of claim 5, further comprising:

responsive to a fuel tank vacuum being less than a vacuum threshold following the vacuum portion of the engine-off natural vacuum test, indicating an evaporative emissions system leak.

7. The method of claim 1, where the evaporative emissions leak test is an evaporative leak check module based test.

8. The method of claim 7, further comprising:

isolating an evaporative leak check module from the fuel tank;

activating a vacuum pump comprising the evaporative leak check module;

drawing a vacuum across a reference orifice; and setting the pressure threshold based on the vacuum drawn across the reference orifice.

9. The method of claim 8, further comprising:
coupling the evaporative leak check module to the fuel tank;
activating the vacuum pump; and
drawing a vacuum on the fuel tank.

10. The method of claim 9, further comprising:
responsive to a fuel tank pressure being greater than the adjusted pressure threshold, indicating an evaporative emissions system leak.

11. A method for an evaporative emissions system leak test, comprising:
determining a reference vacuum threshold;
venting fuel vapor from a fuel tank;
determining a fuel Reid Vapor Pressure of the fuel vapor;
adjusting the reference vacuum threshold based on the fuel Reid Vapor Pressure;
drawing a vacuum on a fuel tank with an evaporative leak check module; and
indicating degradation of the evaporative emissions system based on the adjusted reference vacuum threshold.

12. The method of claim 11, where determining the reference vacuum threshold further comprises:
isolating an evaporative leak check module from the fuel tank;
activating a vacuum pump comprising the evaporative leak check module;
drawing a vacuum across a reference orifice; and
determining a reference vacuum in the evaporative leak check module.

13. The method of claim 12, where determining a fuel Reid Vapor Pressure of the fuel vapor further comprises:
venting fuel vapor from the fuel tank to a fuel vapor canister;
determining a hydrocarbon percentage of the fuel vapor with a hydrocarbon sensor coupled between the fuel tank and the fuel vapor canister; and
determining a fuel Reid Vapor Pressure based on the hydrocarbon percentage of the fuel vapor.

14. The method of claim 13, where indicating degradation of the evaporative emissions system based on the adjusted reference vacuum threshold further comprises:
coupling the evaporative leak check module to the fuel tank;
activating the vacuum pump; and
determining a resulting vacuum in the fuel tank.

15. The method of claim 14, further comprising:
indicating degradation of the evaporative emissions system if the resulting vacuum in the fuel tank is less than the adjusted reference vacuum threshold.

16. A method for an evaporative emissions system leak test, comprising:
responsive to an engine off condition, closing a canister vent valve;
determining a resulting pressure of a fuel tank;
determining a Reid Vapor Pressure of a fuel in the fuel tank;
determining a threshold pressure based on the fuel Reid Vapor Pressure; and
comparing the resulting pressure of the fuel tank to the threshold pressure.

17. The method of claim 16, where determining a Reid Vapor Pressure of a fuel in the fuel tank further comprises:
opening the canister vent valve;
determining a hydrocarbon percentage of a fuel vapor in the fuel tank; and
determining the Reid Vapor Pressure of the fuel in the fuel tank based on the hydrocarbon percentage of the fuel vapor.

18. The method of claim 16, further comprising:
responsive to the resulting pressure of the fuel tank being greater than the threshold pressure, indicating no degradation of the fuel tank.

19. The method of claim 18, further comprising:
responsive to the resulting pressure of the fuel tank being less than the threshold pressure, closing the canister vent valve; and
comparing a resulting fuel tank vacuum to a vacuum threshold.

20. A method for an evaporative emissions leak test, comprising:
where the evaporative emissions leak test is an evaporative leak check module based test, isolating an evaporative leak check module from a fuel tank;
activating a vacuum pump comprising the evaporative leak check module;
drawing a vacuum across a reference orifice;
setting a pressure threshold based on the vacuum drawn across the reference orifice;
adjusting the pressure threshold based on a fuel volatility of a fuel contained in the fuel tank; and
performing the evaporative emissions leak test based on the adjusted pressure threshold.

* * * * *